US008800769B2

(12) United States Patent
Ehde

(10) Patent No.: US 8,800,769 B2
(45) Date of Patent: Aug. 12, 2014

(54) PACKAGING ASSEMBLY FOR WIPER ASSEMBLY

(71) Applicant: Trico Products Corporation, Rochester Hills, MI (US)

(72) Inventor: Daniel Ehde, Ortonville, MI (US)

(73) Assignee: Trico Products Corporation, Rochester Hills, MI (US)

( * ) Notice: Subject to any disclaimer, the term of this patent is extended or adjusted under 35 U.S.C. 154(b) by 0 days.

(21) Appl. No.: 13/677,540

(22) Filed: Nov. 15, 2012

(65) Prior Publication Data

US 2014/0131238 A1 May 15, 2014

(51) Int. Cl.
*B65D 73/00* (2006.01)

(52) U.S. Cl.
USPC ..... 206/471; 206/495

(58) Field of Classification Search
USPC ..... 206/495, 467, 471, 349
See application file for complete search history.

(56) References Cited

U.S. PATENT DOCUMENTS

| | | | | |
|---|---|---|---|---|
| 1,152,471 | A | 9/1915 | Anthony | |
| D184,213 | S | 1/1959 | Despres | |
| D200,555 | S | 3/1965 | Iwanski | |
| 3,363,755 | A | 1/1968 | Chaurd | |
| 3,754,641 | A * | 8/1973 | Koch | 206/6.1 |
| D241,014 | S | 8/1976 | Barnhart et al. | |
| D242,326 | S | 11/1976 | Thorman et al. | |
| D251,896 | S | 5/1979 | Nissen | |
| 4,202,485 | A | 5/1980 | Fremion | |
| 4,283,001 | A | 8/1981 | Meyers | |
| 5,027,947 | A * | 7/1991 | Reighart | 206/335 |
| D327,013 | S | 6/1992 | Reighart | |
| D337,206 | S | 7/1993 | Crawford | |
| D347,170 | S | 5/1994 | Due et al. | |
| 5,379,895 | A | 1/1995 | Foslien | |
| D357,626 | S | 4/1995 | Snow et al. | |
| 5,417,341 | A | 5/1995 | Petriekis et al. | |
| D368,027 | S | 3/1996 | Baker | |
| D389,401 | S | 1/1998 | Holley, Jr. | |

(Continued)

FOREIGN PATENT DOCUMENTS

| | | |
|---|---|---|
| JP | 07251862 A | 10/1995 |
| KR | 10-2011-0066922 | 6/2011 |

OTHER PUBLICATIONS

Notice of References for U.S. Appl. No. D658,494 on Dec. 16, 2011.

(Continued)

*Primary Examiner* — Anthony Stashick
*Assistant Examiner* — Raven Collins
(74) *Attorney, Agent, or Firm* — Howard & Howard Attorneys PLLC

(57) ABSTRACT

A packaging assembly for enclosing a wiper assembly includes a base having a bottom, a first side, a second side opposing said first side, and an accommodation space to receive the wiper assembly between the first side and the second side. The packaging assembly also includes a cover connected pivotally to the second side of the base, the cover having a top, opposing first and second sides, and an accommodation space to receive the wiper assembly between the opposing first and second sides. The base having a recess in the second side near a center thereof to receive a portion of the wiper assembly to center the wiper assembly in the packaging assembly white providing optimal curvature for the wiper assembly.

20 Claims, 4 Drawing Sheets

(56) References Cited

U.S. PATENT DOCUMENTS

| | | | |
|---|---|---|---|
| 5,772,031 | A | 6/1998 | Landis |
| D396,631 | S | 8/1998 | DuGrenier et al. |
| 5,873,514 | A | 2/1999 | Brooks |
| D406,755 | S | 3/1999 | Garganese |
| 5,899,334 | A | 5/1999 | Domerchie et al. |
| D413,261 | S | 8/1999 | Yerich |
| 6,070,723 | A | 6/2000 | Lewis |
| D430,015 | S | 8/2000 | Himbert et al. |
| D434,226 | S | 11/2000 | Strohmeier |
| 6,247,590 | B1 | 6/2001 | Baker |
| 6,279,746 | B1 | 8/2001 | Hussaini et al. |
| 6,766,906 | B2 | 7/2004 | Charng |
| 6,779,658 | B2 | 8/2004 | Polloni et al. |
| 7,032,755 | B2 | 4/2006 | Martins |
| 7,036,664 | B2 | 5/2006 | Lee et al. |
| D540,163 | S | 4/2007 | Claussen |
| D552,486 | S | 10/2007 | Herring et al. |
| D554,991 | S | 11/2007 | Donnelly |
| D573,457 | S | 7/2008 | Park |
| D575,146 | S | 8/2008 | Lee |
| 7,690,509 | B2 | 4/2010 | Herring et al. |
| 7,857,133 | B2 | 12/2010 | Skurdalsvold et al. |
| D632,557 | S | 2/2011 | Clamagirand et al. |
| 7,926,659 | B2 | 4/2011 | Kim |
| 7,975,849 | B2 | 7/2011 | Kim |
| 8,042,690 | B2 * | 10/2011 | Lewis ..... 206/471 |
| 2005/0252812 | A1 | 11/2005 | Lewis |
| 2007/0017842 | A1 | 1/2007 | Clamagirand et al. |
| 2007/0235362 | A1 | 10/2007 | Lewis |
| 2008/0128478 | A1 | 6/2008 | Quadrelli |
| 2008/0230404 | A1 | 9/2008 | Park |
| 2010/0307940 | A1 | 12/2010 | Kim |

OTHER PUBLICATIONS

PCT/US2013-069580 International Search Report and Written Opinion dated Feb. 17, 2014.

* cited by examiner

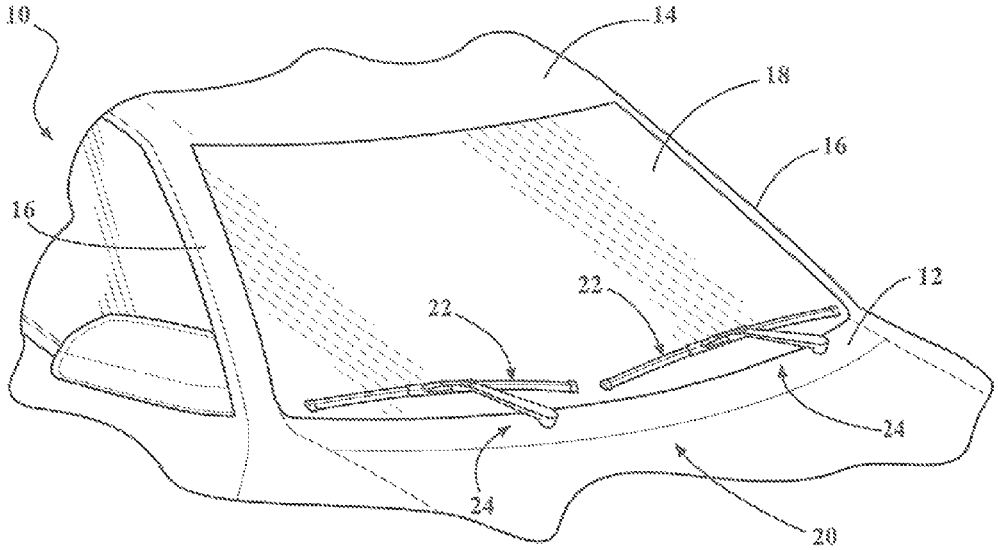
FIG. 1
FIG. 2
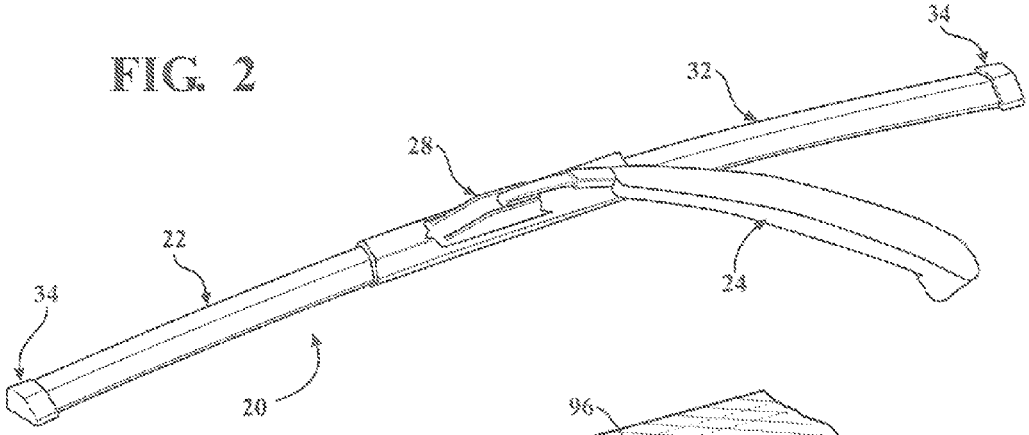
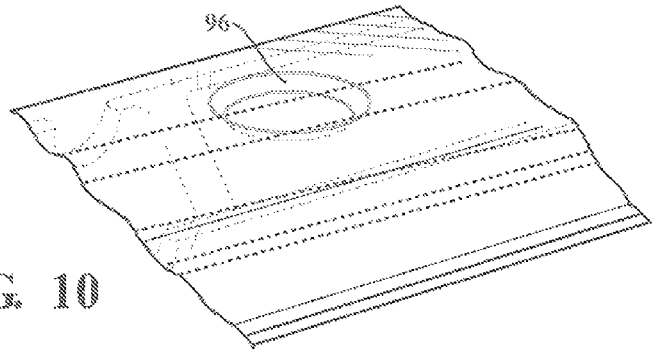
FIG. 10

PACKAGING ASSEMBLY FOR WIPER ASSEMBLY

BACKGROUND OF THE INVENTION

1. Field of the Invention

The present invention relates generally to wiper assembles for vehicles and, more specifically, to a packaging assembly for a wiper assembly for connection to a wiper arm of a vehicle.

2. Description of the Related Art

Conventional wiper assemblies for a vehicle known in the related art include some type of wiper assembly mounted to a wiper arm which, in turn, is mounted adjacent a surface to be wiped such as a windshield of the vehicle and pivotally driven to impart reciprocating motion to the wiper assembly across the windshield. The wiper assembly typically includes a rubber wiping element that contacts the windshield across the surface to be wiped. Generally, a wiper assembly may be classified into one of two categories commonly referred to as, "tournament-style" wiper assemblies and "beam-blade" wiper assemblies.

Beam-blade style wiper assemblies include a single elongated, homogeneous strip forming a spring backbone. The backbone is operatively coupled to the wiper arm by a fixed connecting formation at a central position. In a beam-blade style wiper assembly the reciprocally driven wiper arm applies a downward force and moves the wiper assembly across the surface to be wiped, which is generally a windshield. The backbone is carved along a single plane which is the same plane of curvature as that defined by the windshield. The wiping element or blade is fixedly secured to the backbone. One example of a beam-blade style windshield wiper assembly can be found in U.S. Pat. No. 6,675,433 issued to Stewart, et al., on Jan. 13, 2004 and assigned to the Assignee of the present invention, Trico Products Corporation.

When such a wiping element is worn out or lowered in contacting or wiping force due to long term use, it is necessary to replace it with a new wiper assembly, which is generally encased in a separate packaging case and sold therewith. However, the packaging case typically requires the wiper assembly to be straightened, which causes the wiper assembly to slide down in the packaging case. As such, the wiper assembly accommodated in the packaging case is likely to experience scratching, peeling-off of paint, and the like due to contact with the packaging case during delivery or distribution. In addition, if the wiper assembly is accommodated in a curved shape corresponding to a rounded race of the windshield, the packaging case occupies a large volume in a packaging state, causing an increase in delivery and distribution costs, which is undesired.

Accordingly, there is a need in the art for a new packaging assembly for a wiper assembly that allows for the curvature of the wiper assembly and prevents the wiper assembly from sliding down in the packaging assembly. There is also a need in the art for a packaging assembly for a wiper assembly having a mechanism to center and hold the wiper assembly securely therein. In addition, there is a need in the art for a packaging assembly that is designed for a beam blade-style wiper assembly.

SUMMARY OF THE INVENTION

The present invention overcomes many limitations and disadvantages in the related art in a packaging assembly for enclosing a wiper assembly includes a base having a bottom, a first side, a second side opposing said first side, and an accommodation space to receive the wiper assembly between the first side and the second side. The packaging assembly also includes a cover connected pivotally to the second side of the base, the cover having a top, opposing first and second sides, and an accommodation space to receive the wiper assembly between the opposing first and second sides. The base having a recess in the second side near a center thereof to receive a portion of the wiper assembly to center the wiper assembly in the packaging assembly while providing optimal curvature for the wiper assembly.

Thus, one advantage of the present invention is that a new packaging assembly is provided for a wiper assembly having a base and cover to enclose the wiper assembly therein. Another advantage of the present invention is that a recess located near a center of the base enables the wiper assembly to be centered in the middle of the package and prevent a wiping element of the wiper assembly from contacting a bottom of the base. This feature is unique as it prevents the wiping element from coming in contact with the bottom of the package if it is ever dropped, thus preventing damage from occurring. Yet another advantage of the present invention is that the recess also allows the wiping element to display more curvature in a confined area and demonstrate the natural features of a beam blade. A further advantage of the present invention is that a step located in the front of the package assembly allows the wiper assembly to be seated inside of the package assembly and is designed to prevent damage or set to the wiping element during long term storage.

Other objects, features, and advantages of the present invention will be readily appreciated as the same becomes better understood after reading the subsequent description taken in connection with the accompanying drawings.

BRIEF DESCRIPTION OF THE DRAWINGS

FIG. 1 is a partial perspective view of a front of a vehicle having a pair of wiper assemblies pivotally mounted for reciprocal movement across a windshield of the vehicle.

FIG. 2 is an enlarged perspective view of the wiper assembly of FIG. 1.

FIG. 10 is a partial perspective view of a portion of the packaging assembly in accordance with the embodiment illustrated in FIG. 4 illustrating an alternate embodiment.

DETAILED DESCRIPTION OF THE PREFERRED EMBODIMENT(S)

Figure 3:
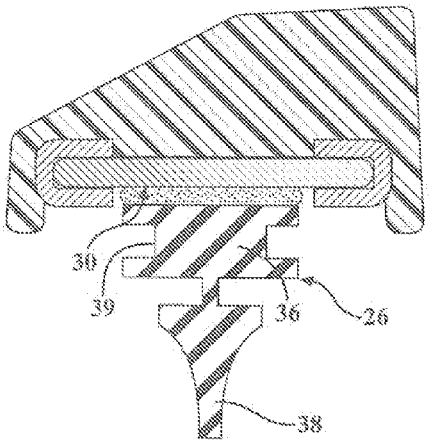
FIG. 3 is a sectional view of the wiper assembly of FIG. 1.
Figure 6:
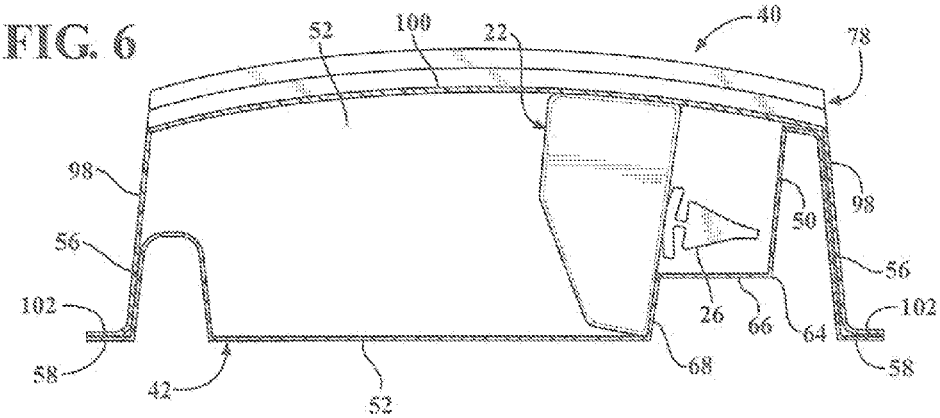
FIG. 6 is a sectional view taken along line 6-6 of FIG. 5.
Figure 7:
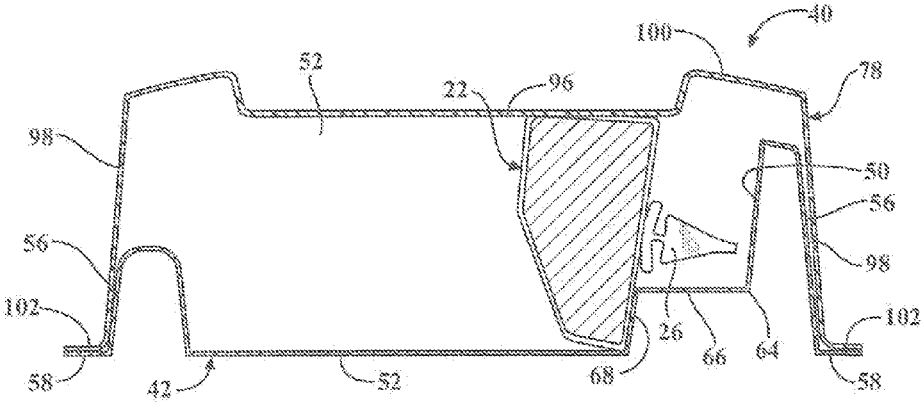
FIG. 7 is a sectional view taken along line 7-7 of FIG. 5.
Figure 4:
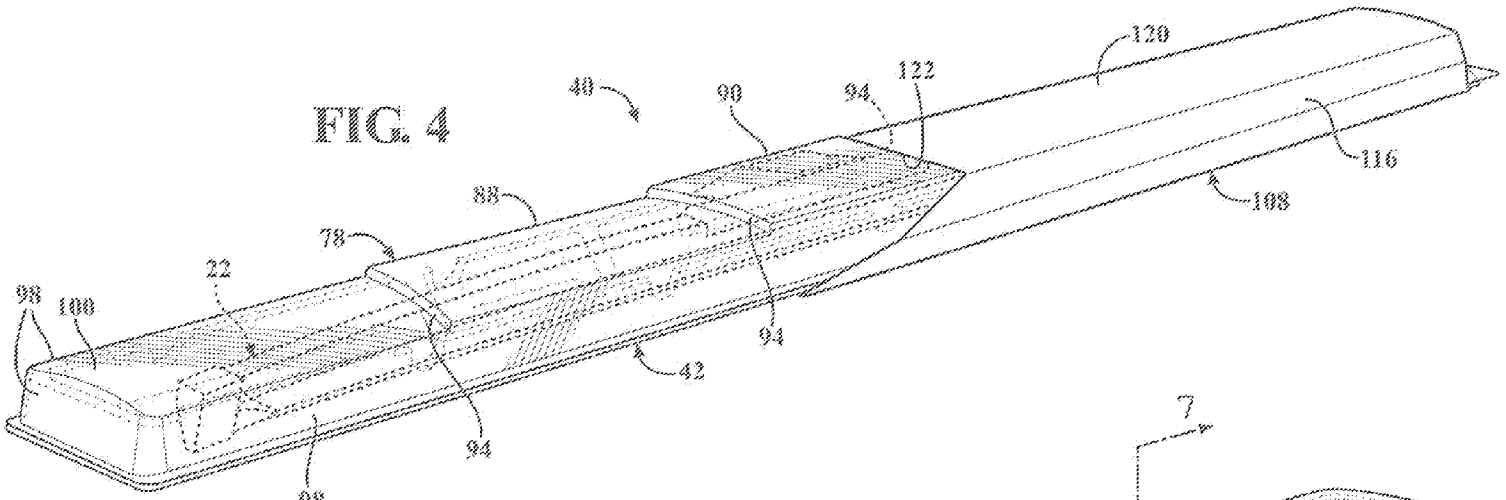
FIG. 4 is a perspective view of a packaging assembly for a wiper assembly in accordance with one embodiment of the present invention to replace the wiper assembly of FIG. 1.
Figure 5:
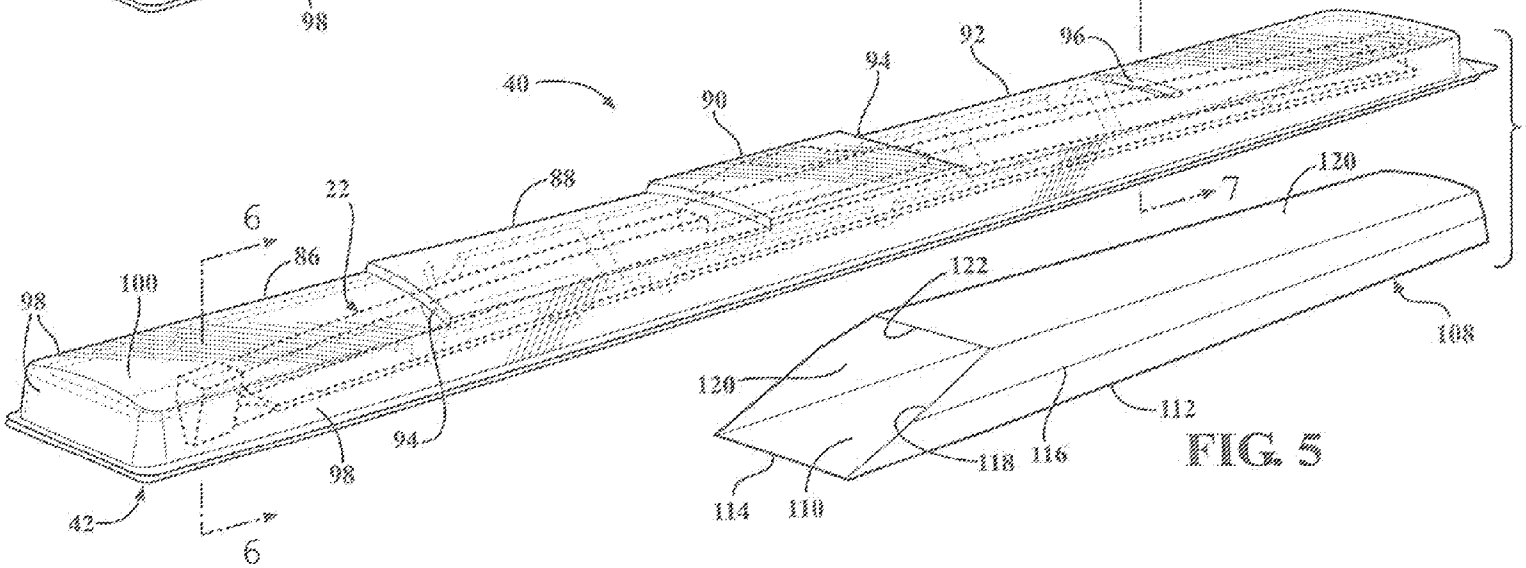
FIG. 5 is a perspective view of the packaging assembly of FIG. 4 with a sleeve removed.
Figure 8:
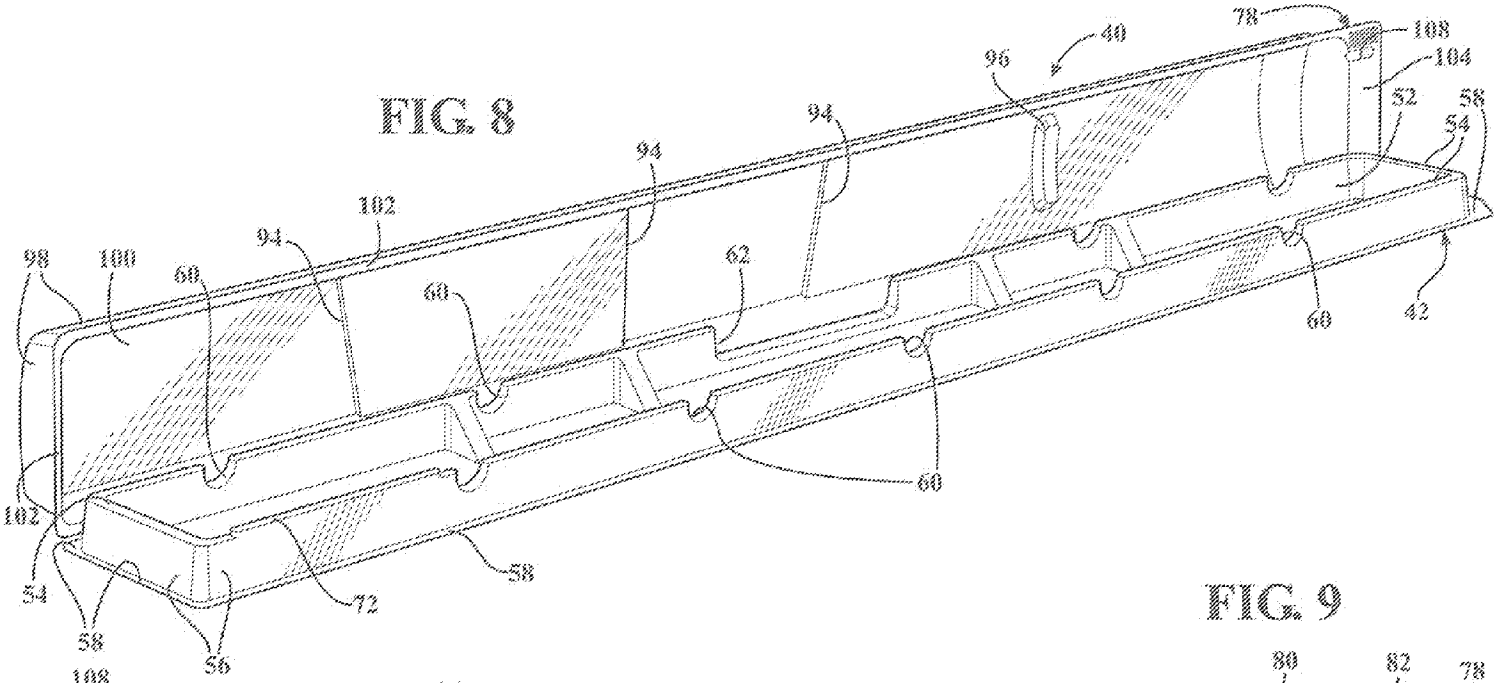
FIG. 8 is a perspective view of the packaging assembly in accordance with the embodiment illustrated in FIG. 4 in an open position and the wiper assembly removed.
Figure 9:
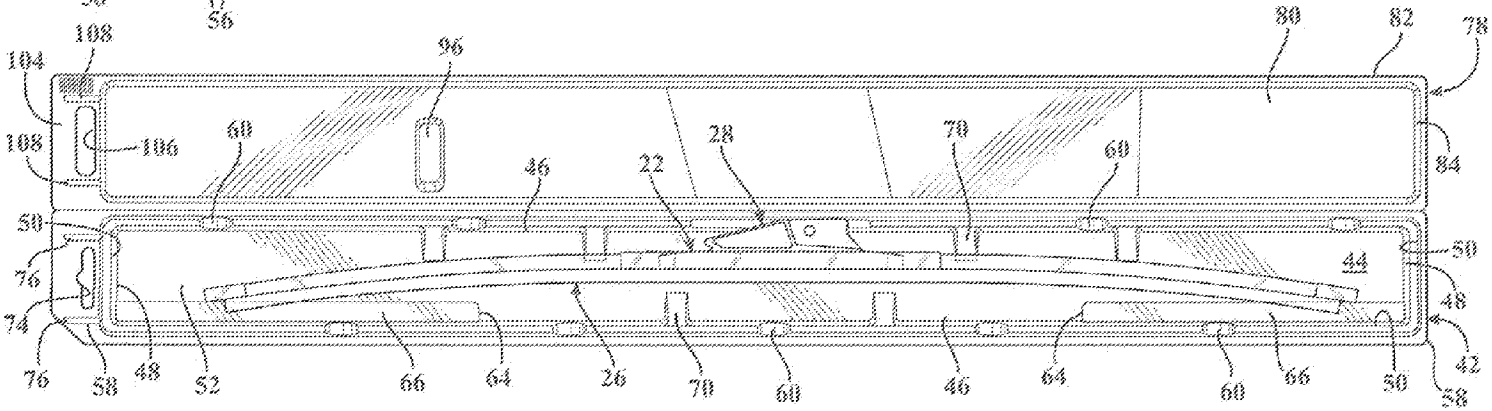
FIG. 9 is a top view of the packaging assembly in accordance with the embodiment illustrated in FIG. 4.

Referring now to the figures, where like numerals are used to designate tike structure, a portion of a vehicle is illustrated at 10 in FIG. 1. The portion of the vehicle 10 includes a body having a cowl 12, a roof 14, and a pair of laterally spaced front or "A" pillars 16 extending between the roof 14 and the cowl 12. The A-pillars 16, roof 14, and cowl 12 cooperate to define a generally rectangular perimeter, which supports a curved or "swept back" windshield 18.

A wiper system is generally indicated at 20 in FIG. 1 and is employed to clean the windshield 18. In the representative example illustrated herein, the wiper system 20 includes a pair of wiper assemblies, generally indicated at 22, and which correspond to the driver and passenger side of the vehicle 10. However, those having ordinary skill in the art will appreciate that the wiper system 20 could employ a single wiper assembly 22 without departing from the scope of the present invention. Each wiper assembly 22 (hereinafter "wiper assembly") is carried by a corresponding wiper arm assembly, generally indicated at 24. The wiper arm assembly 24 includes an attachment member (not shown) adapted to operatively engage the wiper assembly 22. The wiper system 20 also includes an electrical motor (not shown but generally known in the art) to power the wiper arm assembly 24 to move the blade wiper assemblies 22 in an oscillating manner across the surface of the windshield 18.

While the wiper assembly 22 illustrated in FIG. 1 is shown in connection with the front windshield 18 of the vehicle 10, those having ordinary skill in the art will appreciate that wiper assemblies 22 may be employed in other areas of the vehicle 10, such as a rear window (not shown) or a head lamp (not shown) that employs a wiper system. Thus, it will be understood that the present invention is not limited for use solely in connection with wiper arm assemblies 24 and wiper assemblies 22 adapted for use on a vehicle's windshield 18, but for use in all applications where wiper arm assemblies 24 and wiper assemblies 22 are employed.

Referring to FIGS. 2 and 3, the wiper assembly 22 includes a wiping element generally indicated at 26, that is adapted to contact the surface of the vehicle 10 to be wiped, in this representative example, the windshield 18. In addition, the wiper assembly 22 includes a coupler assembly, generally indicated at 28, that acts to interconnect the wiper arm assembly 24 and the wiping element 26. The wiper assembly 22 also includes at least one elongated beam 30 that defines a longitudinal axis and that acts to support the wiping element 26. The coupler 28 may connect the beam 30 to the wiper arm assembly 24. The wiper assembly 22 may also include an airfoil assembly, generally indicated at 32, and a pair of end caps, generally indicated at 34. It should be appreciated that the coupler assembly 28 is adapted to connect the wiper assembly 22 to the wiper arm assembly 24 in any suitable manner commonly known in the art. It should also be appreciated that the coupler assembly 28 includes structure that corresponds to at least one particular type of wiper arm assembly attachment member, but may include structure that corresponds to multiple types of wiper arm assembly attachment members. By way of example, different OEM's employ wiper arm assemblies having different attachment members adapted to operatively engage a specific type of wiper assembly. Accordingly, the coupler assembly 28 illustrated herein includes structure that operatively engages at least one or more of these different attachment members. Further by way of example, certain wiper arm assemblies employed by OEM's include "bayonet-style"; "pin-type"; or "hook-type" attachment members of various sizes that operatively engage the wiper assemblies. Accordingly, the coupler assembly 28 illustrated herein may include an adapter 29 for operatively engaging at least one or more of these different attachment members for use in connection with the wiper assemblies 22 without departing from the scope of the present invention. It should be appreciated that, while a particular coupler is illustrated herein, any suitable coupler assembly 28 may be used to interconnect the wiper arm assembly 24 and the wiping element 26 without departing from the scope of the present invention.

As best shown in FIG. 3, the wiping element 26 includes an upper section 36 and a lower section 38 that are partitioned by a longitudinally extending bridge portion 39. The bridge portion 39 provides flexibility between the upper section 36 and lower section 38 during operational movement of the wiper assembly 22 across the surface to be wiped. The wiping element 26 includes a predetermined length corresponding to particular application and is often manufactured through an extrusion process, which enables the length of the wiping element 26 to be easily adjusted without a substantial increase to manufacturing expense. Furthermore, while the wiping element 26 of the present invention is constructed from a flexible rubber, those having ordinary skill in the art will appreciate that it may be constructed from any flexible material such as silicone or other polymer without departing tram the scope of the present invention.

The beam 30 may be constructed from a resiliently flexible material, such as spring steel or a polymer, and is adapted to apply force from an intermediate position between first and second longitudinal ends to the first and second longitudinal ends. More specifically, the beam 30 receives force from the spring-loaded wiper arm assembly 24 at an intermediate position and distributes this force across the span of the beam 30 toward the first and second longitudinal ends. To that end, the beam 30 may be curved longitudinally with a predetermined radius of curvature. This predetermined radius of curvature is sometimes referred to in the related an as a "free form" radius of curvature. Accordingly, the curvature of the beam 30 may be symmetrical or asymmetrical depending on the force requirements and the contour of the windshield 18. The flexible, free form, pre-curved beam 30 straightens out when the wiper arm assembly 24 applies a force thereto to flatten the beam 30 and directs the wiping element 26 to contact the windshield 18. Thus, the elongated beam 30 includes a free-form curvature that ensures force distribution on windshields having various curvatures that effects proper wrapping about the windshield 18.

Referring to FIGS. 4 through 9, one embodiment of a packaging assembly, generally shown at 40 and according to the present invention, is used for packaging the wiper assembly 22 prior to assembly to the wiper arm assembly 24. The wiper assembly 22 is given a predetermined curvature corresponding to the curvature of the surface to be wiped such as the windshield. Such a wiper assembly 22 is provided as a replaceable component and is commonly available irons automobile specialty shops, large distribution and discount stores, etc. The wiper assembly 22 can be sold in a separate packaging assembly 40 for identification and protection of the products. The packaging assembly 40 prevents damage of the wiper assembly 22 accommodated therein and enables the wiper assembly 22 to be maintained in an optimal state.

As illustrated in the figures, the packaging assembly 40 includes a base, generally indicated at 42, having a bottom wall 44 that is generally planar and rectangular in shape. The bottom wall 44 has longitudinally extending sides 46 and laterally extending ends 48. The longitudinal sides 46 extend a distance substantially longer than the ends 48. The base 42 also includes a plurality of interior side walls 50 extending generally perpendicular to the bottom wall 44 to form a predetermined accommodating space 52 defined therein to accommodate the wiper assembly 22. The interior side walls 50 are generally planar and rectangular in shape. The base 42 also includes a plurality of top walls 54 extending generally perpendicular to the interior side walls 50. The top walls 54 are generally planar and rectangular in shape. The base 42 includes a plurality of outer side walls 56 extending generally perpendicular to the top wall 54. The outer side walls 56 are generally planar and rectangular in shape. The base 42 further includes a plurality of bottom flanges 58 extending generally perpendicular to the outer side walls 56. The bottom flanges 58 are generally planar and perpendicular in shape. It should be appreciated that the walls of the base 42 transition at the corners such that the corners are rounded and may include an indentation therein for strengthening.

The packaging assembly 40 includes one or more first recesses 60 extending into the top walls 54, interior side walls 50, and outer side walls 56 of the base 42. The recesses 60 are generally arcuate in shape. Preferably the recesses 60 are located along the longitudinal sides of the base 42 and are offset relative to opposing longitudinal sides. The packaging assembly 40 also includes a second recess 62 extending into the top wall 54, interior side wall 50, and outer side wall 56 of one of the longitudinal sides of the base 42. The second recess 62 is generally rectangular in shape and extends longitudinally a distance substantially greater than one of the first recesses 60. The second recess 62 is generally centered in one of the longitudinal sides of the base 42. It should be appreciated that the second recess 62 is located in a middle or center of the side wall to act as a centering point for the wiper assembly 22 such that the wiper assembly 22 can always be in same spot regardless of length. It should also be appreciated that the second recess 62 allows the wiper assembly 22 to maintain its original curvature and not be straightened. It should further be appreciated that the second recess 62 allows for a lower height of the packaging assembly 40 and for ease of assembly.

The packaging assembly 40 includes one or more shelves 64 extending from one of the interior side walls 50 along the longitudinal side opposite the longitudinal side containing the second recess 62. Each shelf 64 has a top wall 66 extending laterally and longitudinally into the space 52 and a side wall 68 extending generally perpendicular to the top wall 66 and connected to the bottom wall 44. Each shelf 64 extends longitudinally within the space 52 a predetermined distance from each end of the base 42. It should be appreciated that the shelves 64 correspond to a depth and height of the wiper assembly 22 such that the wiping element 26 does not touch anything but the shelves 64.

The packaging assembly 40 also includes one or more ribs 70 extending from the interior side walls 50 on the longitudinal sides into the space 52. The ribs 70 are generally triangular in shape and are connected to the bottom wall 44. The ribs 70 are spaced longitudinally to strengthen the interior side walls 50 of the base 42 to prevent collapse and retain shape. It should be appreciated that the ribs 70 do not touch the wiping element 26 and keeps curvature of the wiper assembly 22 from distorting.

The packaging assembly 40 further includes a projection 72 extending upwardly from one the top walls 54 along the longitudinal side opposite the longitudinal side containing the second recess 64. The projection 72 is generally rectangular in shape and is located near one end along a portion of the top wall 54. The base 42 includes a display part or end flange 58 extending generally perpendicular to one side wall 56 at one end thereof such that the packaging assembly 40 can be hung on and kept in a display rack used for storage or selling of the wiper assembly 22 encased in the packaging assembly 40. The end flange 58 has a slot 74 extending therethrough such that the packaging assembly 40 can be hung on any display rack having a circular rack rod or a thin plate-shaped rack rod. The slot 74 is generally rectangular in shape. The end flange 58 also includes one or more projections 76 extending upwardly and longitudinally on each side of the slot 74. The projections 76 are spaced laterally from the slot 74. The base 42 is made of a plastic material, preferably a transparent plastic material such as synthetic resins. Specifically, a portion or all of the cover base 42 may be formed of a transparent material to allow a serviceman or a user to see the interior of the packaging assembly 40. The base 42 is integral, unitary and one-piece and is formed by injection molding. It should be appreciated that the packaging assembly 40 may have various colors to allow more easy recognition of the products from other products or to provide distinction of the products and more appealing appearance to the products.

The packaging assembly 40 also includes a cover, generally indicated at 78, connected to the base 42 to cover the accommodating space 52. The cover 78 includes a top wall 80 that is generally planar and rectangular in shape. The top wall 80 has longitudinally extending sides 82 and laterally extending ends 84. The longitudinal sides 82 extend a distance substantially longer than the ends 84. The top wall 80 is stepped or tiered in height configuration to form a plurality of levels 86, 88, 90, 92. In the embodiment illustrated, the top wall 80 has four (4) levels denoted by a plurality of step walls 94 extending upwardly between the levels 86, 88, 90, 92. The step walls 94 are generally straight, but may have any suitable shape. The top wall 89 may also have an angled portion or chamfer (not shown) at one end of the level 92 to provide clearance for a sleeve 108 to be described to slide on the base 42 and cover 78 when assembled together. The angled portion extends downwardly relative to the remainder of the top wall 80. The top wall 80 also includes a recess 96 extending therein. The recess 96 is longitudinally spaced from one end in the level 92. The recess 96 is generally rectangular shape, but may be any suitable shape, such as circular as shown in FIG. 10. It should be appreciated that the recess 96 contacts the wiper assembly 22 and acts to hold down the wiper assembly 22 in the base 42. It should be appreciated that the recess 96 acts as a stop and keeps additional adapters (not shown) for the coupler assembly 28 in the accommodation space 52 under a sleeve 108 to be described.

The cover 78 also includes a plurality of side walls 98 extending generally perpendicular to the top wall 80 to form a predetermined space 100 defined therein to accommodate the wiper assembly 22. The side walls 98 are generally planar and rectangular in shape. One of the side walls 98 is pivotally connected to the flange 58 of the base 42 along one longitudinal side thereof such as along the longitudinal side that contains the second recess 62. The cover 78 further includes a plurality of flanges 102 extending generally perpendicular to the side walls 98. The flanges 102 are generally planar and perpendicular in shape. It should be appreciated that the walls of the cover 78 transition at the corners such that the corners are rounded and may include an indentation therein for strengthening.

The cover 78 also includes one or more projections (not shown) extending outwardly from the side walls 98 at the ends thereof. The projections are generally arcuate in shape. The cover 78 includes a display part or end flange 104 extending generally perpendicular to one side wall 98 at one end thereof such that the packaging assembly 40 can be hung on and kept in a display rack used for storage or selling of the wiper assembly 22 encased in the packaging assembly 40. The end flange 104 is generally rectangular in shape. The end flange 104 has a slot 106 extending therethrough such that the packaging assembly 40 can be hung on any display rack having a circular rack rod or a thin plate-shaped rack rod. The slot 106 is generally rectangular in shape. The end flange 104 also includes one or more recesses 108 extending upwardly and longitudinally on each side of the slot 106. The recesses 108 are spaced laterally from the slot 106. The cover 78 is made of a plastic material, preferably a transparent plastic material such as synthetic resins. Specifically, a portion or all of the cover 78 may be formed of a transparent material to allow a serviceman or a user to see the interior of the packaging assembly 40. The cover 78 is integral, unitary and one-piece and is formed by injection molding. It should be appreciated that the packaging assembly 40 may have various colors to allow more easy recognition of the products from other products or to provide distinction of the products and more appealing appearance to the products.

The packaging assembly 40 may include a sleeve, generally indicated at 108, to fit over one end of the base 42 and cover 78 when assembled together. The sleeve 108 includes a bottom wall 110 that is generally planar and rectangular in shape. The bottom wall 110 has longitudinally extending sides 112 and laterally extending ends 114. The longitudinal sides 112 extend a distance-substantially longer than the ends 114. The sleeve 108 also includes a plurality of side walls 116 extending generally perpendicular to the bottom wall 110 along the longitudinal sides 112 thereof. The side walls 116 are generally planar and rectangular in shape. The side walls 116 may include an angled portion 118 at one end. The angled portion 118 has a generally triangular shape. The sleeve 108 includes a top wall 120 extending generally perpendicular to the side walls 116. The top wall 120 is generally planar and rectangular in shape. The top wall 120 extends a longitudinal distance less than a longitudinal distance of the bottom wall 110 to form an opening 122. The top wall 120 also has an end 124 adjacent the opening 120 that is straight, but may have any suitable shape. The top wall 120 may also have a lateral width less than a lateral width of the bottom wall 110 to form a generally trapezoidal cross-sectional shape. The side walls 116 may flex or bend. The bottom wall 110, side walls 116, and top wall 120 form a hollow interior. The hollow interior has a generally rectangular shape. The sleeve 108 is made of a paper material. The sleeve 108 may include indicia printed thereon such as advertising. The sleeve 108 is integral and one-piece. It should be appreciated that the end 124 of the top wall 120 has a shape complementary to the shape of the step wall of the cover 78 to keep the sleeve 108 from sliding down the packaging assembly 40.

In operation, the present invention includes accommodating the wiper assembly 22 in the packaging assembly 40, according to an embodiment of the present invention, is described with reference to FIGS. 6 through 9. First, the wiper assembly 22 is put in the accommodating space 52 of the base 42. A portion of the coupler assembly 28 is disposed in the second recess 62 and the wiping element 26 may rest on the top walls 66 of the shelves 64. At this time, the wiper assembly 22 is maintained in an unfolded state without any bending, and, the wiping element 26 may be maintained in contact with the shelves 64 of the base 42. Then, the cover 78, which is connected to the one side of the base 42, is rotated to cover the space 52 of the base 42. At this time, the side walls 98 of the cover 78 overlap the outer side walls 56 of the base 42 and the flanges 102 and 58 overlap each other. Then, the sleeve 108 is inserted over one end of the assembled cover 78 and base 42 and slid therealong until the top wall of the sleeve 108 abuts one of the step walls. The second recess 62 on the base 42 located near the center enables the wiping assembly 22 to be centered in the middle of the package assembly 40 and prevents the wiping element 26 from contacting the bottom wall 44 of the base 42. This feature is unique as it prevents the wiping element 26 from coming in contact with the bottom of the package assembly 40 if it is ever dropped thus preventing damage from occurring. The second recess 62 also allows the wiping element 26 to display more curvature in a confined area and demonstrate the natural features of a beam blade style of the wiper assembly 22. It should be appreciated that the step located in the front of the package assembly 40 allows the wiping assembly 22 to be seated inside of the package assembly 40 and is designed to prevent damage or set to the wiping element 26 during long term storage.

As apparent from the above description, according to the present invention, a wiper assembly 22 can be held and firmly secured in a packaging assembly 40 so that the wiper assembly 22 can be protected from the outside and prevented from being damaged by the packaging assembly 40. Moreover, since the packaging assembly 40 can secure a cover 78 to a base 42 of the packaging assembly 40 with ease and tightness, it can reduce time required for packaging. In addition, the packaging assembly 40 centers the wiping assembly 22 in the middle of the package assembly 40 while providing optimal curvature for a beam blade style of wiper assembly 22 as well as protection to prevent deformation to the rubber wiping element 26 and damage to the package assembly 40.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A packaging assembly for enclosing a wiper assembly comprising:

a base having a bottom wall, a first side having a first wall extending from said bottom wall, a second side having a second wall extending from said bottom wall and opposing said first wall of said first side, and an accommodation space defined by said bottom wall, said first wall, and said second wall as a hollow cavity having a generally rectangular and linearly extending shape to receive the wiper assembly;

said base including a plurality of protrusions extending from said second wall into said accommodation space to maintain a curvature of the wiper assembly;

a cover connected pivotally to said second side of said base, said cover having a top, opposing first and second sides, and an accommodation space to receive the wiper assembly between said opposing first and second sides; and said base having a recess extending toward said bottom wall in said second wall of said second side near a center thereof to receive a portion of the wiper assembly to center the wiper assembly in said packaging assembly while providing optimal curvature for the wiper assembly.

2. A packaging assembly as set forth in claim 1 including at least one shelf portion formed in said accommodation space of said base on said first wall of said first side to prevent deformation of a wiping element of the wiper assembly.

3. A packaging assembly as set forth in claim 2 including a pair of shelves formed in said accommodation space of said base on said first wall of said first side and spaced longitudinally from each other to prevent the wiping element from contacting said bottom wall of said base.

4. A packaging assembly as set forth in claim 1 wherein said cover includes a recess in said top of said cover to contact and hold down the wiper assembly.

5. A packaging assembly as set forth in claim 4 wherein said recess has one of a square and circular shape.

6. A packaging assembly as set forth in claim 1 wherein said cover has a top wall stepped or tiered in height configuration to form a plurality of levels.

7. A packaging assembly as set forth in claim 6 wherein said top wall has a plurality of step walls extending upwardly between said levels.

8. A packaging assembly as set forth in claim 7 wherein one of said step walls has a predetermined configuration.

9. A packaging assembly as set forth in claim 8 including a sleeve to fit over one end of said base and said cover when assembled together.

10. A packaging assembly as set forth in claim 9 wherein sleeve has a top wall and an end of said top wall that is complementary to said predetermined configuration to act as a stop for said sleeve.

11. A packaging assembly for enclosing a wiper assembly comprising:

a base having a bottom wall, a first side having a first wall extending from said base wall, a second side having a second wall extending from said base wall and opposing said first wall of said first side, and an accommodation space defined by said bottom wall, said first wall, and said second wall as a hollow cavity having a generally rectangular and linearly extending shape to receive the wiper assembly;

said base including a plurality of protrusions extending from said second wall into said accommodation space to maintain a curvature of the wiper assembly;

a cover connected pivotally to said second side of said base, said cover having a top, opposing first and second sides, and an accommodation space to receive the wiper assembly between said opposing first and second sides; and said base having a recess extending toward said bottom wall in said second wall of said second side near a center thereof to receive a portion of the wiper assembly to center the wiper assembly in said packaging assembly and a pair of shelves formed in said accommodation space on said first wall of said first side and spaced longitudinally from each other to prevent the wiping element from contacting said bottom wall of said base.

12. A packaging assembly as set forth in claim 11 wherein said cover includes a recess in said top of said cover to contact and hold down the wiper assembly.

13. A packaging assembly as set forth in claim 12 wherein said recess has one of a square and circular shape.

14. A packaging assembly as set forth in claim 11 wherein said cover has a top wall stepped or tiered in height configuration to form a plurality of levels.

15. A packaging assembly as set forth in claim 14 wherein said top wall has a plurality of step walls extending upwardly between said levels.

16. A packaging assembly as set forth in claim 15 wherein one of said step walls has a predetermined configuration.

17. A packaging assembly as set forth in claim 16 including a sleeve to fit over one end of said base and said cover when assembled together.

18. A packaging assembly as set forth in claim 17 wherein sleeve has a top wall and an end of said top wall that is complementary to said predetermined configuration to act as a stop for said sleeve.

19. A packaging assembly as set forth in claim 18 wherein sleeve has a bottom wall opposing said top wall and extending longitudinally past said end of said top wall.

20. A packaging assembly for enclosing a wiper assembly comprising:

a base having a bottom wall, a first side having a first wall extending from said bottom wall, a second side having a second wall extending from said bottom wall and opposing said first wall of said first side, and an accommodation space defined by said bottom wall, said first wall, and said second wall as a hollow cavity having a generally rectangular and linearly extending shape to receive the wiper assembly;

said base including a plurality of protrusions extending from said second wall into said accommodation space to maintain a curvature of the wiper assembly;

a cover connected pivotally to said second side of said base, said cover having a top, opposing first and second sides, and an accommodation space to receive the wiper assembly between said opposing first and second sides;

said base having a recess extending toward said bottom wall in said second wall of said second side near a center thereof to receive a portion of the wiper assembly to center the wiper assembly in said packaging assembly and a pair of shelves formed in said accommodation space on said first wall of said first side and spaced longitudinally from each other to prevent the wiping element from contacting said bottom wall of said base;

said cover having said top wall stepped or tiered in height configuration to form a plurality of levels and a plurality of step walls extending upwardly between said levels; and a sleeve to fit over one end of said base and said cover when assembled together and to abut one of said step walls.

* * * * *